United States Patent [19]

Dyett et al.

[11] Patent Number: 4,499,910

[45] Date of Patent: Feb. 19, 1985

[54] CUTTING HEAD FOR A CIGARETTE FILTER ATTACHMENT MACHINE

[75] Inventors: Derek H. Dyett; Godfrey A. Wood, both of High Wycombe, England; Albert D. Seim, II, Richmond, Va.

[73] Assignee: Molins, Ltd., London, England

[21] Appl. No.: 324,031

[22] Filed: Nov. 23, 1981

[30] Foreign Application Priority Data

Nov. 21, 1980 [GB] United Kingdom ..... 8037441

[51] Int. Cl.[3] ..... A24C 5/56

[52] U.S. Cl. ..... 131/95; 493/371; 493/94; 83/348; 83/506

[58] Field of Search ..... 83/346, 347, 348, 506, 83/658, 501; 493/419–421, 371; 131/95

[56] References Cited

U.S. PATENT DOCUMENTS

| | | | |
|---|---|---|---|
| 1,393,524 | 10/1921 | Grupe | 83/348 |
| 2,450,312 | 9/1948 | Tollison | 83/347 |
| 2,518,960 | 8/1950 | Tollison et al. | 83/347 |
| 3,209,633 | 10/1965 | Doerman | 83/348 |
| 3,496,820 | 2/1970 | Utzmann et al. | 83/506 |
| 3,731,575 | 5/1973 | Gelin | 83/348 |
| 3,777,607 | 12/1973 | Schofield | 83/506 |
| 3,800,640 | 4/1974 | Barrie | 83/346 |
| 3,877,335 | 4/1975 | Lange | 83/501 |
| 4,372,327 | 2/1983 | Dyett et al. | 131/95 |

FOREIGN PATENT DOCUMENTS

| | | | |
|---|---|---|---|
| 32344 | 10/1923 | Denmark | 83/348 |
| 1104390 | 2/1968 | United Kingdom | 83/658 |

*Primary Examiner*—V. Millin
*Assistant Examiner*—Harry J. Macey
*Attorney, Agent, or Firm*—Antonelli, Terry & Wands

[57] ABSTRACT

This invention is concerned with a cutting head for a cigarette filter attachment machine, for cutting a filter attachment web at regular intervals in cooperation with a cutting drum, comprising a rotary member which carries one or more knives, an arrangement for urging the rotary member towards the cutting drum with a predetermined force, and a damping member arranged to resist movement of the rotary member towards the cutting drum, at least along part of the range of such movement. Each end of the rotary member is preferably supported by a separately movable carrier member, each carrier member having its own urging arrangement and its own damping member. The or each damping member may comprise a dashpot or a rubber pad or sleeve.

20 Claims, 3 Drawing Figures

CUTTING HEAD FOR A CIGARETTE FILTER ATTACHMENT MACHINE

This invention is concerned with a cutting head for a filter attachment machine, which is a machine for making filter cigarettes by joining filter portions to tobacco rods by means of uniting bands. These bands are cut from a web of filter attachment material by a cutting head which is the subject of this invention.

This invention is an improvement or modification of the invention described in our European patent application No. 80300776.4.

According to the present invention, a cutting head for cutting a filter attachment web at regular intervals, in cooperation with a cutting drum, comprises a rotary member which carries one or more knives, means for urging the rotary member towards the cutting drum with a predetermined force, and a damping member arranged to resist movement of the rotary member towards the cutting drum, at least along part of the range of such movement.

Examples of cutting heads according to this invention are shown diagrammatically in the accompanying drawings, where:

Figure 1:
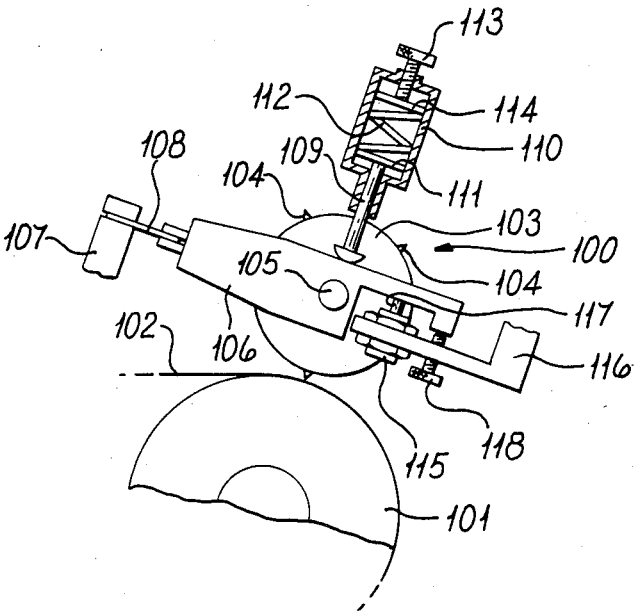
FIG. 1 is a diagrammatic view in elevation of a cutting head in accordance with one embodiment of the present invention.

In FIG. 1, a cutting head 100 and cutting drum 101 are shown for cutting a web 102 at regular intervals. Portions cut from the web 102 are held on the drum 101 by suction in the manner commonly employed in the Molins PA8 filter attachment machine.

The cutting head comprises a rotary member 103 which carries five circumferentially spaced knives 104 and is itself mounted on a shaft 105 by which the member 103 is driven so that the knives move at the same speed as the periphery of the drum 101. Each end of the shaft 105 is carried by an arm 106 which is pivotally mounted at its left-hand end on a fixed member 107 by means of a short leaf spring 108 of which opposite ends are clamped respectively to the arm and to the fixed member.

Each arm 106 is urged towards the cutting drum by a push rod 109 extending from a fixed cylinder 110. Inside the cylinder the push rod carries a flange 111 which is urged downwards by a compression spring 112. A screw 113 bears on a disc 114 adjacent to the upper end of the spring and can be adjusted to alter the force of the spring on the push rod.

Movement of the cutting head towards the drum 101 between successive cuts is resisted by a dashpot 115 which is mounted on a fixed frame member 116 and has a plunger 117 engaging the underneath surface of an extension of the arm 106. A screw 118 engaging in the frame member 116 serves as an adjustable stop limiting downward movement of the arm 106.

Each dashpot 115 comprises a sealed hydraulic unit and includes an internal spring urging the plunger 117 outwards (i.e. upwards). Upward movement of the plunger 117 encounters little resistance within the dashpot itself since the dashpot has a unidirectional damping action; i.e it serves to damp only inward (downward) movement of the plunger 117. A suitable dashpot for this purpose is that manufactured by ACE Controls Inc, P.O. Box 71, Farmington MI48024, which company markets the dashpot under the trade name Adjust-A-Shock, a specific model being that designated 3/4-16 UNF 2A. This model has an adjustment facility whereby the damping of inward movement of the plunger is adjustable.

As an alternative, each arm 106 may have two such dashpots engaging respectively above and below it, so that the resistance to movement of the arm in both directions can be adjusted.

Instead of simply containing a spring, the cylinder 110 may be fed with pneumatic or hydraulic fluid to urge the flange 111 downwards; in that case the flange would carry a seal (preferably of the annular diaphragm type) cooperating with the wall of the cylinder. Alternatively, each cylinder may be replaced by any other known actuator for urging the corresponding arm 106 downwards when the cutting head is in use.

Figure 2:
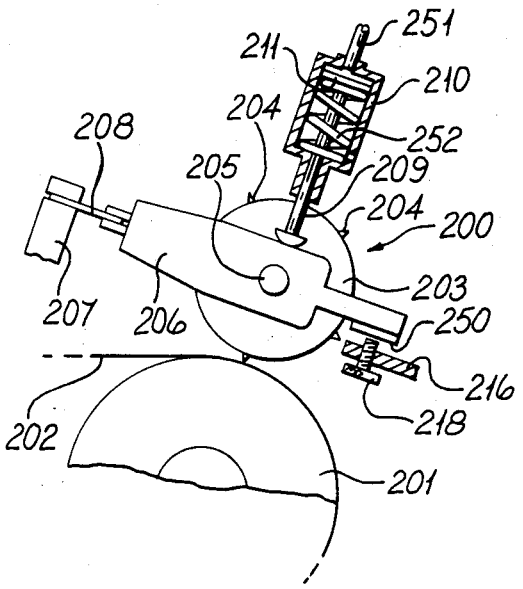
FIG. 2 is a diagrammatic view in elevation of a cutting head forming a second embodiment of the present invention.

FIG. 2 shows an arrangement which is basically the same as that shown in FIG. 1, as indicated by the use of the similar reference numerals (increased by 100) for parts which are the same or very similar. One difference is that, in place of each dashpot of FIG. 1, there is a rubber pad 250 which is mounted on an extension of the corresponding arm 206. During the final stage of movement of the rotary member 203 towards the cutting drum 201, each of the rubber pads 250 engages the corresponding adjustable stop 218 so as to damp the movement. In practice the stops may be set so that they just touch or are very slightly spaced from the pads 250 when a knife 204 is in contact with the cutting drum, as shown in FIG. 2. Thus the rubber pads serve to resist and damp movement of the rotary member towards the cutting drum between cuts, i.e. while no knife is in contact with the cutting drum.

Another difference in FIG. 2 is that each push rod 209 is urged downwards by pneumatic pressure supplied to the cylinder 210 via a pipe 251. Also, each cylinder includes a spring 252 which lightly urges the push rod upwards so as to lift the rotary member and knives clear of the cutting drum while no compressed air is being supplied to the cylinders.

Figure 3:
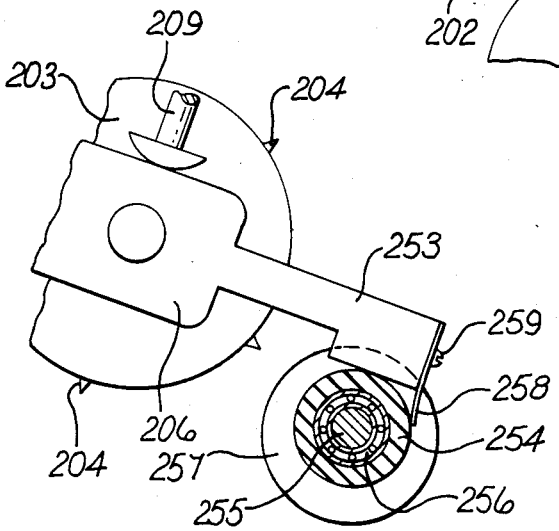
FIG. 3 is a diagrammatic view in elevation of a cutting head forming a third embodiment of the present invention.

FIG. 3 shows part of a different arrangement which is a modification of that shown in FIG. 2. An extension 253 of each arm 206 is arranged to engage a rubber damping member in the form of a sleeve 254 which is rotatably mounted around a trunnion 255 via a roller bearing 256. The trunnion itself is mounted eccentrically on a rotatably adjustable member 257, so that manual adjustment (rotation) of the member 257 about its own axis raises or lowers the rubber sleeve 254, which is shown in FIG. 3 in its most raised position.

The rubber sleeve 254 serves the same purpose as the rubber pad 250 in FIG. 2. However, rotation of the sleeve provides a changing surface for engagement with the arm extension 253, thus prolonging its effective life. Deliberate step-wise rotation of the sleeve may be achieved by means of a flexible projection in the form of a leaf spring 258 secured to the arm extension 253 by screws 259, rotation of the sleeve being achieved as a result of the repeated small upwards and downwards movement of the arm 206.

We claim:

1. A cutting head for a cigarette filter attachment machine, for cutting a filter attachment web at regular intervals in cooperation with a cutting drum, comprising a rotary member which carries one or more knives, means for movably supporting said rotary member, means acting on said supporting means for urging the rotary member towards the cutting drum with a predetermined force, and means associated with said supporting means and including a damping member arranged to resist movement of the rotary member towards the cutting drum, at least along part of the range of such movement.

2. A cutting head according to claim 1 in which each end of the rotary member is supported by a separately movable carrier member forming said supporting means for said rotary member, each carrier member having its own urging means and its own damping member.

3. A cutting head according to claim 1 or claim 2 in which the or each urging means comprises a spring.

4. A cutting head according to claim 1 or claim 2 in which the or each urging means comprises a pneumatic actuator.

5. A cutting head according to claim 1 or claim 2 in which the or each damping member comprises a dashpot arranged to produce a predetermined resistance to movement of the rotary member towards the cutting drum and less resistance to movement of the rotary member away from the cutting drum.

6. A cutting head according to claim 1 or claim 2 in which the or each damping member comprises a part of rubber or rubber-like material which is arranged to be compressed so as to damp at least the final stage of movement of the rotary member towards the cutting drum.

7. A cutting head according to claim 6 in which the or each rubber or rubber-like part is mounted on said supporting means and is arranged to engage a fixed stop which is adjustable in position.

8. A cutting head according to claim 6 in which the or each rubber or rubber-like part comprises a sleeve which is rotatable about its axis so that the part of the sleeve which is compressed to provide the damping action is constantly changing or is changeable.

9. A cutting head according to claim 8 in which the sleeve is arranged to rotate about a fixed axis and is engaged by a projection on said supporting means so as to be rotated stepwise by the projection.

10. A cutting head according to claim 8 or claim 9 in which the rubber or rubber-like sleeve is carried eccentrically by a rotatable adjusting member.

11. A cutting head for a cigarette machine, for cutting a filter attachment web at regular intervals in cooperation with a cutting drum, comprising a rotary member which carries one or more knives, means for urging the rotary member towards the cutting drum with a predetermined force, and a damping member arranged to resist movement of the rotary member towards the cutting drum, at least along part of the range of such movement, in which each end of the rotary member is supported by a separately movable carrier member and in which each carrier member is pivotally mounted on a fixed member by means of a leaf spring.

12. A cutting head for a cigarette filter attachment machine, for cutting a filter attachment web at regular intervals in cooperation with a cutting drum, comprising a rotary member which carries one or more knives, carrier means including at least one carrier member for supporting said rotary member at the respective ends thereof, flexible means for pivotally mounting said carrier means, means for urging the rotary member towards the cutting drum with a predetermined force, and means including a damping member operatively associated with said carrier means for resisting movement of the rotary member towards the cutting drum at least along part of the range of such movement.

13. A cutting head according to claim 12, wherein said flexible means comprises a leaf spring mounted on a fixed member.

14. A cutting head according to claim 12, wherein said flexible means comprises a resilient member coupling said carrier member to a fixed member.

15. A cutting head according to claim 12, in which said damping member comprises a rubber-like part mounted on said carrier member and arranged to engage a fixed stop which is adjustable in position.

16. A cutting head according to claim 12, in which said damping member comprises a resilient sleeve and means for mounting said resilient sleeve for rotation about its axis and at a position where it is intermittently contacted and compressed by a part of said carrier member so that the part of the sleeve which is compressed to provide the damping action is changed with rotation of said sleeve.

17. A cutting head according to claim 16, further including means carried by said carrier member for effecting rotation of said sleeve.

18. A cutting head according to claim 17, wherein said means for effecting rotation of said sleeve comprises a member projecting from said carrier member and engaging said sleeve so as to rotate said sleeve stepwise with each intermittent contact by a part of said carrier member with said sleeve.

19. A cutting head according to claim 16, wherein said sleeve is carried eccentrically by a rotatable adjusting member.

20. A cutting head for a cigarette filter attachment machine, for cutting a filter attachment web at regular intervals in cooperation with a cutting drum, comprising a rotary member which carries one or more knives, each end of said rotary member being supported by a separately-movable carrier member pivotally mounted on a fixed member by means of a leaf spring, means for urging the rotary member towards the cutting drum with a predetermined force, and a damping member for each carrier member arranged to resist movement of the rotary member towards the cutting drum at least along part of the range of such movement.

* * * * *